US007268282B2

(12) United States Patent
Nieuwkamp

(10) Patent No.: US 7,268,282 B2
(45) Date of Patent: Sep. 11, 2007

(54) DOT REED GRADING FOR WIND INSTRUMENTS

(76) Inventor: Arent E. Nieuwkamp, 211 Saint Charles, Greenfield Park, PQ (CA) J4V 2K6

( * ) Notice: Subject to any disclaimer, the term of this patent is extended or adjusted under 35 U.S.C. 154(b) by 2 days.

(21) Appl. No.: 11/282,838

(22) Filed: Nov. 21, 2005

(65) Prior Publication Data

US 2006/0107817 A1 May 25, 2006

Related U.S. Application Data

(60) Provisional application No. 60/629,893, filed on Nov. 23, 2004.

(51) Int. Cl.
*G10D 9/02* (2006.01)

(52) U.S. Cl. ..... 84/383 A; 84/330

(58) Field of Classification Search ..... 84/383 A, 84/330, 350–351, 360–364, 375, 456, 376 R, 84/376 A; D17/13
See application file for complete search history.

(56) References Cited

U.S. PATENT DOCUMENTS 1,667,836 A 5/1928 Brockman, Jr.
1,795,219 A 3/1931 Kingsbury
D119,602 S 3/1940 Verville
D122,783 S 10/1940 Schwartz
2,318,515 A 5/1943 Nemcek, Jr.
3,420,132 A 1/1969 Backus
4,337,683 A * 7/1982 Backus ..... 84/383 A
2002/0002894 A1 1/2002 Sullivan

FOREIGN PATENT DOCUMENTS

JP 10-282955 10/1998

* cited by examiner

*Primary Examiner*—Lincoln Donovan
*Assistant Examiner*—Jianchun Qin
(74) *Attorney, Agent, or Firm*—Richard C. Litman

(57) ABSTRACT

The marking system for musical instrument reeds uses one or more marks placed (e.g., printed, engraved, embossed, etc.) on the blunt end of a musical instrument reed, opposite the thin, vibratory portion of the reed. These markings indicate the grade or relative stiffness of the reed, i.e., its resistance to vibration when the instrument is played. The markings of the system correspond to the conventional Arabic numeral system used to indicate the grade of reeds, but the present markings are placed upon the blunt end of the reed where they are visible when the reed is installed in the instrument mouthpiece or when the reed is in storage in a typical reed holder. One or more marks are placed toward one side of the blunt end of the reed to represent integers, while a single mark is placed to the opposite side (when required) to indicate half values.

17 Claims, 7 Drawing Sheets

DOT REED GRADING FOR WIND INSTRUMENTS

CROSS-REFERENCE TO RELATED APPLICATION

This application claims the benefit of U.S. Provisional Patent Application Ser. No. 60/629,893, filed Nov. 23, 2004.

BACKGROUND OF THE INVENTION

1. Field of the Invention

The present invention relates generally to musical instrument reeds, and more particularly to a non-numerical system for indicating the grade of a particular reed.

2. Description of the Related Art

Wind instruments, particularly woodwinds, utilize one or more reeds disposed at an opening in the mouthpiece of the instrument. Single reed instruments, such as clarinets and saxophones, utilize a relatively large, single reed disposed over a single mouthpiece opening. The reed is shaped with a very thin, free edge oriented toward the mouth of the player, which vibrates or resonates due to the airflow thereover as the instrument is played. It has been found that reeds cut with different thicknesses along their free edges produce different sound qualities and require different amounts of air or "wind" from the player of the instrument. The differentiation of these reeds has developed to the point that certain numerical values are assigned to different thicknesses of reeds, with thinner, more flexible reeds having lower numbers and thicker, stiffer reeds requiring greater "wind" having higher numbers.

Reed numbers generally range between one and five in increments of one half, with the Arabic numeral being applied to the flat or lower surface of the reed (as it is installed within the mouthpiece of the musical instrument). As the number of the reed is disposed directly against the flat surface or "lay" of the mouthpiece, it is concealed from view when the reed is installed in the mouthpiece of the instrument.

Reeds are generally stored in reed holders, which are configured to hold the reed flat in order to keep it from warping as it dries after use. As in the case where the reed is installed in the mouthpiece of the instrument, the flat surface of the reed having the number thereon is held securely and directly against a flat surface in the reed holder. Unless the reed holder is transparent, the reed number cannot be viewed through the flat back surface of the holder.

Many musicians use a few different reeds during play, depending upon the particular piece of music, their musical skills, the "voice" of the instrument (e.g., alto or soprano clarinet, etc.), and perhaps other factors as well. A musician may have occasion to change reeds during a rest occurring in a musical performance, but may have only a few bars to make the change. Reeds can be damaged or become warped during play as well, requiring the musician to change the reed as soon as possible. A musician may play more than a single instrument during a performance, e.g., a baritone and an alto saxophone, with the two instruments requiring different reeds. Where a musician uses various reeds of different grades and numbers and/or different instruments, it can be confusing to pick out a given reed grade and number, particularly if the musician may not remember specifically which reed number he or she was using in a given instrument beforehand and the reed number is concealed.

The present inventor is aware of a number of different reed configurations having different patterns of grooves, composite construction of different materials, etc. Most of these different reed configurations are intended to affect the vibratory frequency or resonance of the reed in some manner, with others having various non-standard configurations providing for attachment to the mouthpiece of the musical instrument in some non-standard manner. However, the present inventor is not aware of any other reed which includes a grade marking system which is visible when the reed is installed in the mouthpiece of the instrument, or when the reed is stored within a conventional reed holder having an open end.

Thus a marking system for musical instrument reeds solving the aforementioned problems is desired.

SUMMARY OF THE INVENTION

The marking system for musical instrument reeds comprises one or more markings (e.g., dots, lines, geometrical figures, etc.) stamped, painted, printed, embossed, engraved, or otherwise marked on the blunt end of a musical instrument reed. The blunt end of the reed, i.e., the end opposite the tapered free end that resonates as the instrument is played, is clearly visible at all times when the reed is installed within the musical instrument. This blunt end is also generally visible in many reed holders, particularly those holders that are at least partially open in order to allow moisture to evaporate from the reed.

The markings used in the present system serve to indicate the grade or stiffness of the reed, and correspond to conventional Arabic numbers conventionally stamped upon the flat surface of the reed and used to indicate the grade of the reed. Marks to the left side of the blunt end of the reed represent integers, while a single mark to the opposite right side, if present, would indicate a half gradient. For example, a single mark (dot, etc.) is equivalent to a number one reed. Two such marks toward one side are equivalent to a number two reed, etc. One mark toward one side and another mark toward the opposite side of the blunt end of the reed indicate a reed having a grade of 1½, while two marks toward one side and a single mark toward the opposite side indicate a grade of 2½. Using the present system, it is impossible to confuse integers and fractions, as a single mark to each side of the reed end is symmetrical and would thus be read the same regardless of the orientation of the reed. More than one mark toward one side would indicate an integer greater than one, as only a single mark is used to indicate a half gradient. Raised marks or depressions, or even fluorescent or phosphorescent markings to provide legibility in low lighting conditions often encountered in musical performances, may also be applied to the present system.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1A, 1B:
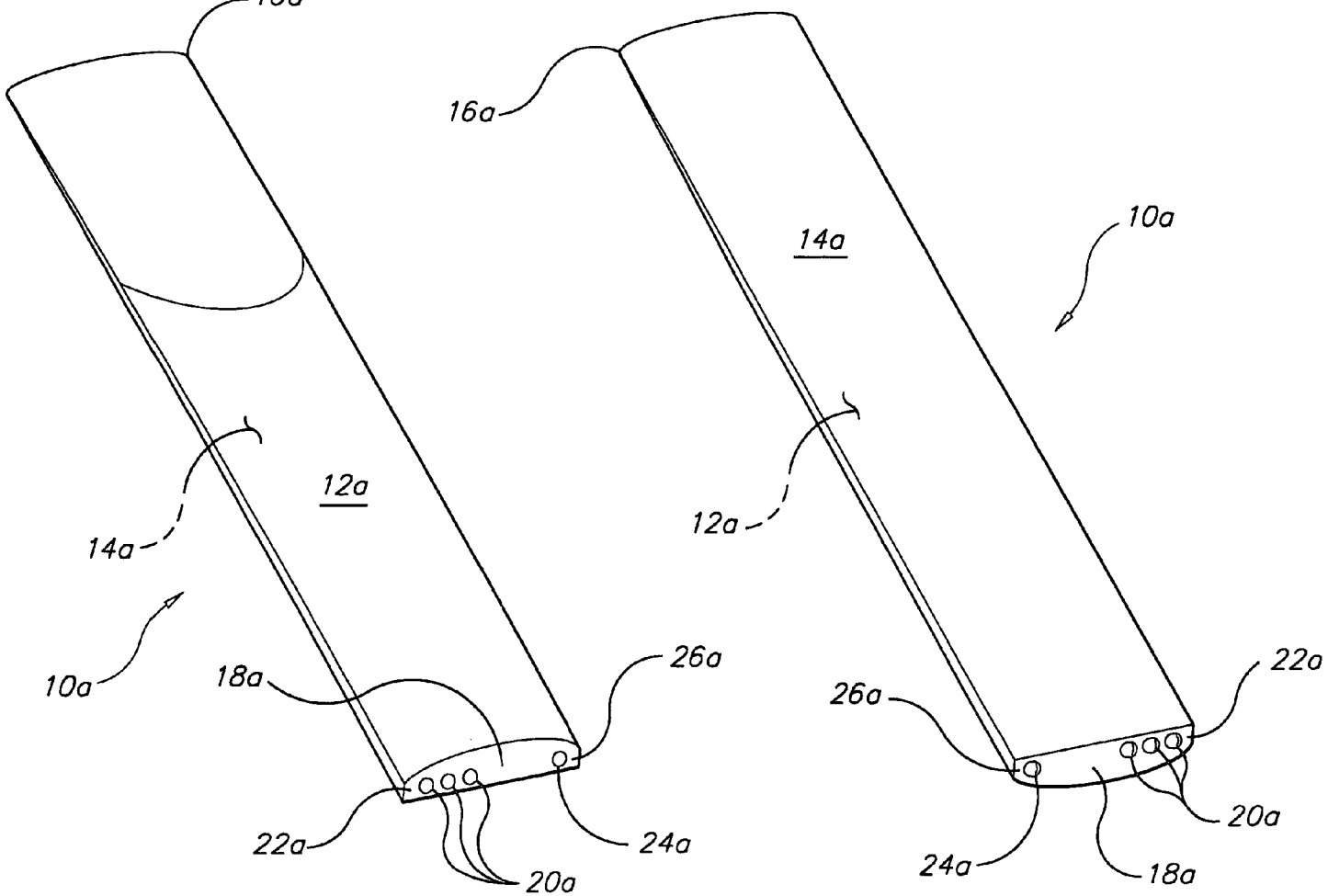
FIG. 1A is a top, end perspective view of a musical instrument reed showing the marking system thereon according to an embodiment of the present invention.
FIG. 1B is a bottom, end perspective view of the reed of FIG. 1A.

The present invention comprises various embodiments of a marking system for musical instrument reeds, with the system permitting the markings (and thus the grade of the reed) to be viewed even though the reed is installed within the mouthpiece of a musical instrument or placed within a reed holder. FIGS. 1A and 1B respectively illustrate top and bottom end perspective views of a relatively broad single reed 10*a* for a musical instrument (e.g., clarinet, saxophone, etc.). The reed 10*a* is conventional excepting the present marking system and lack of other grading indication, with the reed 10*a* having a curved upper surface 12*a* generally conforming in radius to the radius of the musical instrument mouthpiece to which it is removably secured and an opposite flat bottom surface 14*a* which fits against the lay of the mouthpiece. The reed 10*a* further has a tapered end portion 16*a*, with the tapered end 16*a* being shaped to provide a particular resonance or tonal quality when the instrument is played. The tapered end 16*a* may be cut or trimmed to have different thicknesses as desired, with thinner reeds requiring less "wind" or breath for resonance than thicker reeds.

These reed characteristics are conventionally indicated by an Arabic numeral placed upon the flat surface 14*a* of the reed. As this surface is directly adjacent the lay of the mouthpiece when the reed is installed therein, it is impossible to view the reed number when the reed is installed. The same problem occurs when the reed is placed within many types of reed holders for storage between uses. Reeds for any given type of instrument (e.g., clarinet) all have extremely similar appearances, and it is impossible to determine what the characteristics of a given reed might be merely by looking at the reed per se. Thus, the reed must be removed from the musical instrument mouthpiece or from its reed holder, in order to view the number provided on the back surface of the reed and to determine the grade of the reed.

The present invention provides a solution to this problem by providing a marking system disposed upon the blunt end of the reed, i.e., the end opposite the tapered resonant end. FIGS. 1A and 1B provide illustrations of the present marking system on the blunt end 18*a* of the reed 10*a*, with a series of three dark circular dots 20*a* disposed upon the first side 22*a* of the blunt end 18*a*, and another single dot 24*a* disposed upon the opposite second side 26*a* of the blunt end 18*a*. The series of marks 20*a* and 24*a* are preferably arranged in a linear array, as shown, along the relatively narrow height of the blunt end 18*a* of the reed 10*a*. The first three dots or marks 20*a* represent the Arabic numeral integer indicating the grade of the reed 10*a* by means of the cut or trim of the vibratory, resonant tapered end 16*a*.

Reeds may be further divided into half gradients between integer gradients. The single dot or mark 24*a* disposed to the second side 26*a* of the blunt end 18*a*, represents such a half indication. Thus, the reed 10*a* of FIGS. 1A and 1B would have a grade of 3½, with the three marks 20*a* representing the Arabic integer 3 and the single mark 24*a* representing the half gradient.

Figure 2B:
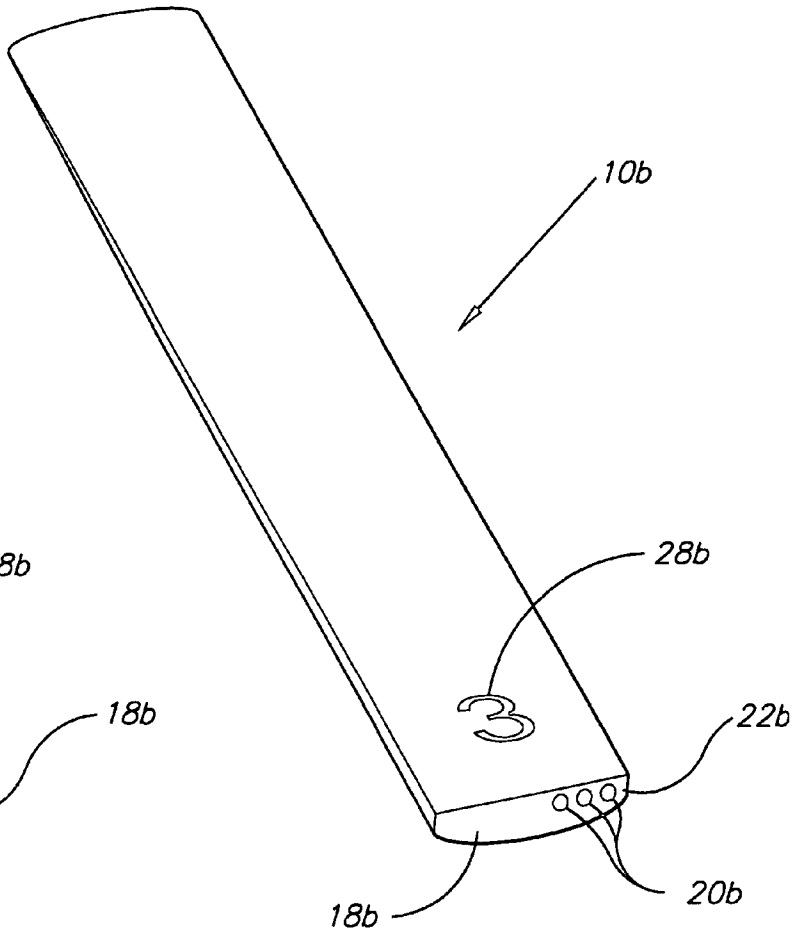
FIG. 2B is a bottom, end perspective view of the reed of FIG. 2A.
Figure 2A:
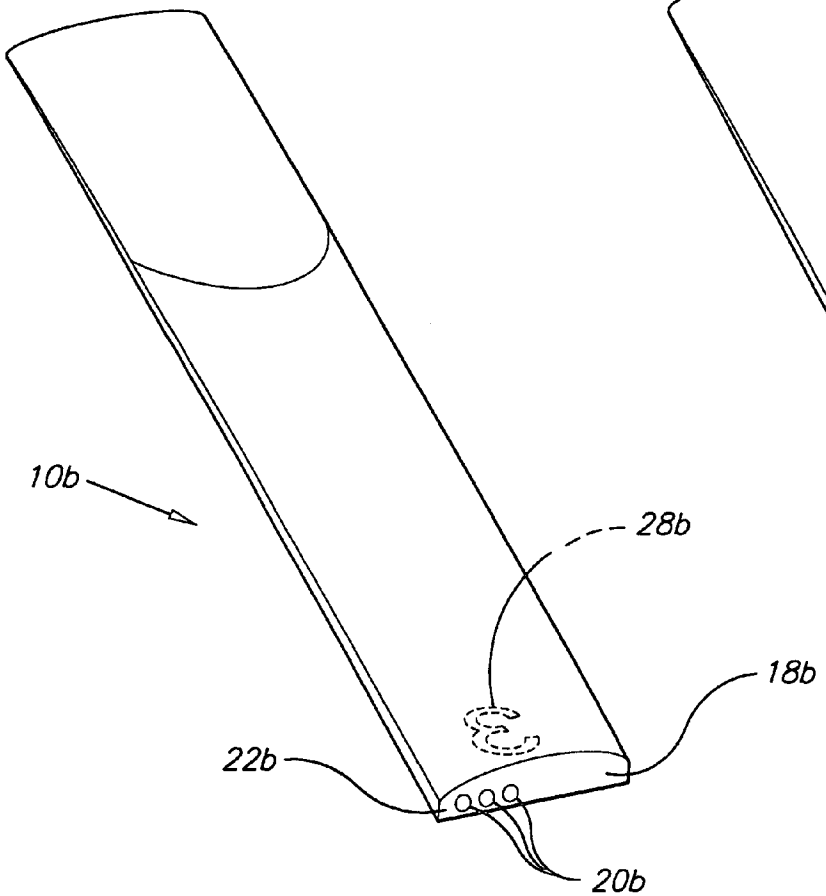
FIG. 2A is a top, end perspective view of an alternate embodiment of the present marking system, incorporated on a reed having conventional numerical marking.

FIGS. 2A and 2B illustrate another example of the present marking system, with a reed 10*b* including a conventional gradient number 28*b* thereon. The number indicates that this reed 10*b* has a grade of three, i.e. having intermediate characteristics. It will be noted that in the top perspective view of FIG. 2A, the Arabic gradient number is concealed, being shown only in hidden lines in FIG. 2A. This is the orientation the reed 10*b* would normally have when installed in a musical instrument mouthpiece, with the gradient number 28*b* being concealed from view. The present marking system resolves this problem, with the grade of the reed 10*b* being indicated by the three integer dots or marks 20*b* placed upon the blunt end 18*b* of the reed 10*b*, extending across the blunt end 18*b* from the first side 22*b* thereof. No fractional marking is provided on the reed 10*b*, as the reed 10*b* does not have a fractional grading.

Figure 3A:
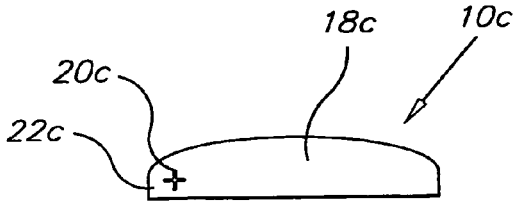
FIG. 3A is an end elevation view of a no. 1 reed having a plus symbol indicator according to the present invention.

FIGS. 3A through 7 illustrate additional embodiments of the present marking system, as well as showing the entire range of reed grades or rankings conventionally provided. FIG. 3A illustrates an elevation view of a reed 10*c* having a blunt end 18*c*. This is a no. 1 reed, as indicated by the single mark 20*c* disposed upon the first end 22*c* of the end 18*c*. No fractional mark is provided on the reed 10*c* of FIG. 3A. The mark 20*c* is a plus symbol, rather than the dots shown on the reeds 10*a* and 10*b* of FIGS. 1A through 2B. The specific configuration of the mark(s) or symbol(s) used is not critical, as will be seen in FIGS. 4A through 7 and described further below. The mark(s) may be any regular or irregular geometric or non-geometric shape(s), pattern(s), or other symbol(s), as desired. While Arabic numerals, Roman numerals, etc. could be used for the present marking system, it may prove difficult to provide sufficient legibility given the limitation of the thickness of the reed, and thus the maximum height of the blunt end of the reed upon which the present marking system is placed. Accordingly, the use of a series of integer marks, along with a single fractional mark as needed, is desired.

Figure 3B:
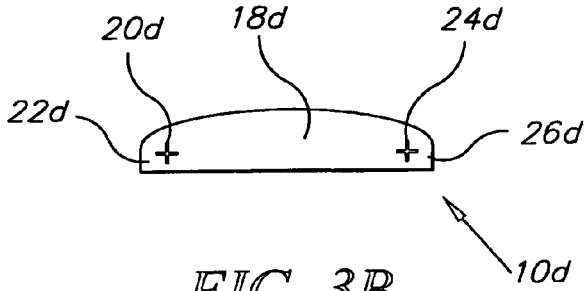
FIG. 3B is an end elevation view of a no. 1.5 reed according to the present invention, using plus symbols.

FIG. 3B illustrates the blunt end 18*d* of another reed 10*d* having a gradient value of 1½. This is indicated by a single integer mark 20*d* upon the first side 22*d* of the blunt end 18*d*, and a second fractional mark 24*d* disposed upon the opposite second side 26*d* of the blunt end. It will be noted that confusion is not possible regarding which of the marks represents the integer and which represents the fraction, as the two marks are symmetrically disposed for the 1½ gradient reed 10*d* of FIG. 3B.

Figure 4A:
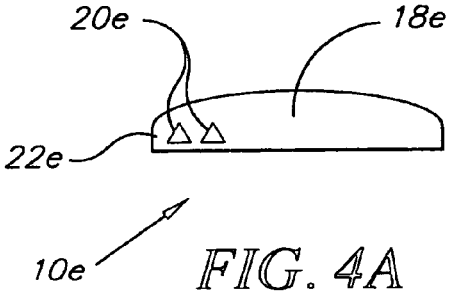
FIG. 4A is an end elevation view of a no. 2 reed according to the present invention having triangle symbol indicators.
Figure 4B:
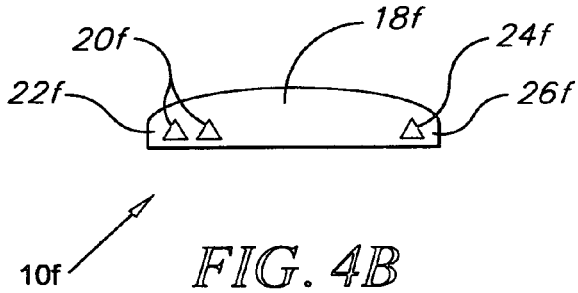
FIG. 4B is an end elevation view of a no. 2.5 reed according to the present invention, using the triangle symbols.

FIG. 4A illustrates yet another embodiment of the present marking system, in which a no. 2 reed 10*e* is marked with a pair of triangular integer marks 20*e* upon the left side 22*e* of the blunt end 18*e*. FIG. 4B illustrates the use of such markings to indicate a no. 2½ reed 10*f*, with the markings comprising a set of two integer marks 20*f* adjacent the first side 22*f* of the blunt end 18*f*, and a single fractional marker 24*f* adjacent the opposite right side 26*f* indicating the additional ½ value. Again, it is not possible to confuse the integer and fractional marks, as there will never be more than a single fractional mark (and no fractional mark where there is no fractional gradient). Plural marks will always comprise integer marks, using the present system.

Figure 5A:
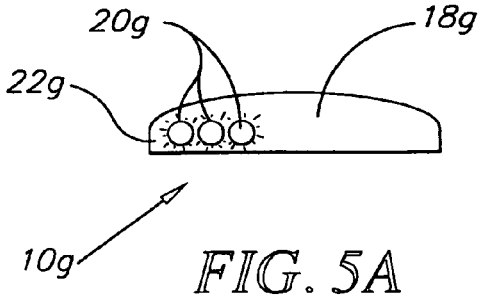
FIG. 5A is an end elevation view of a no. 3 reed according to the present invention having three phosphorescent, circular dot indicators.
Figure 5B:
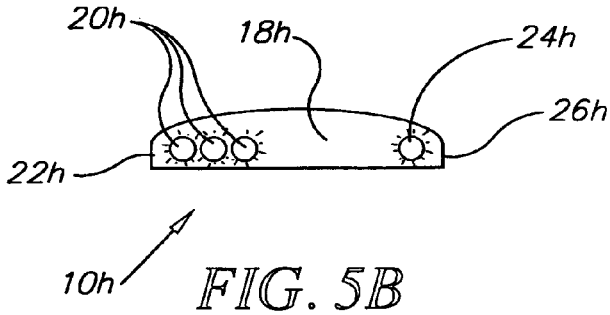
FIG. 5B is an end elevation view of a no. 3.5 reed according to the present invention, using the phosphorescent dot symbols.

FIG. 5A illustrates the blunt end 18*g* of a reed 10*g* employing phosphorescent or fluorescent markings, which facilitate determination of the reed gradient in poor lighting. Oftentimes, musical performances are given in subdued lighting, and it may be difficult for a musician to read conventional numbers or markings placed upon a musical instrument reed. Accordingly, FIG. 5A illustrates a reed 10*g* having a series of three phosphorescent or fluorescent circular dots 20*g* disposed upon the blunt end 18*g* of the reed, adjacent the first side 22*g* thereof. A reed 10*h* having a fractional gradient of 3½ is illustrated in FIG. 5B, with the blunt end 18*h* having three fluorescent or phosphorescent integer marks 20*h* adjacent the first side 22*h* of the blunt end, and a single fluorescent or phosphorescent fractional mark 24*h* adjacent the opposite second side 26*h* of the blunt end 18*h*. Other means for making the marks visible in low lighting, e.g., making them highly reflective, may also be used in the present reed marking system as desired.

Figure 6B:
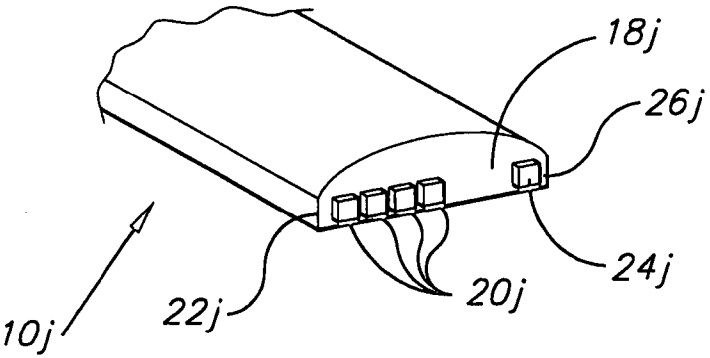
FIG. 6B is a broken away perspective view of the blunt end of a no. 4.5 reed according to the present invention, using the raised rectangular indicators.
Figure 6A:
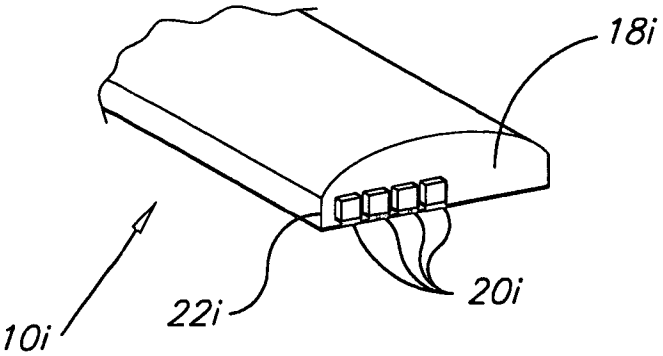
FIG. 6A is a broken away perspective view of the blunt end of a no. 4 reed according to the present invention having raised rectangular indicators.

FIGS. 6A and 6B illustrate still another embodiment of the present invention, in which the marks are raised from the surface of the blunt end of the reed. In FIG. 6A, the blunt end 18*i* of a no. 4 reed 10*i* is provided with a series of four raised integer marks 20*i* adjacent the first end 22*i* of the blunt end 18*i*. The marks 20*i* may be squares or rectangles, as shown, or any other practicable shape or configuration as desired. Such raised markings assist the musician in sensing the gradient of the reed by tactile means in low light conditions. FIG. 6B illustrates the blunt end 18*j* of a reed 10*j* having a fractionally higher gradient than the reed 10*i*, with the reed 10*j* having a series of four raised marks 20*j* disposed upon the left side 22*j* of the blunt end 18*j*, and a fractional mark 24*j* extending slightly from the opposite right end 26*j* of the blunt end. The combination of the four integer marks 20*j* and the fractional mark 24*j* indicates a reed gradient of 4½ for the reed 10*j* of FIG. 6B.

Figure 7:
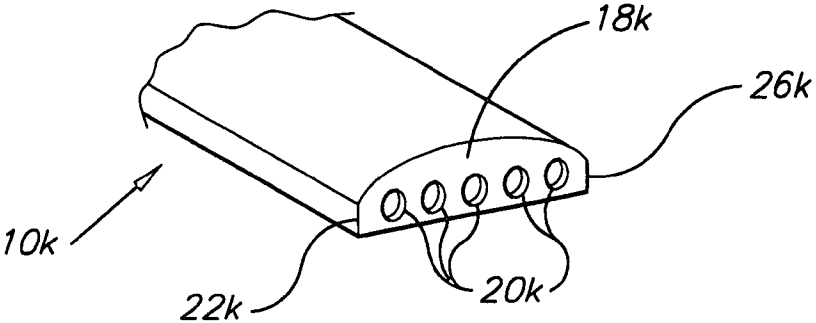
FIG. 7 is a broken away perspective view of the blunt end of a no. 5 reed according to the present invention, having indented circular indicators.

FIG. 7 illustrates yet another embodiment of the present reed marking system, in which a series of five recessed dots or marks 20*k* are inset into the blunt end 18*k* of the reed 10*k*. Normally, reeds are not provided with a stiffer resonance than that indicated by a no. 5 reed, i.e. there are no numbers higher than 5. Accordingly, the five integer marks 20*k* extend completely across the blunt end 18*k* of the reed 10*k*, from the first side 22*k* to the opposite second side 26*k*. However, if it were necessary to provide indications for a reed gradient above 5, the same system as described above could be followed by clustering the five marks closer to the first side of the blunt end (but preferably still in a linear array), with a single fractional mark disposed adjacent the opposite side.

Figure 8:
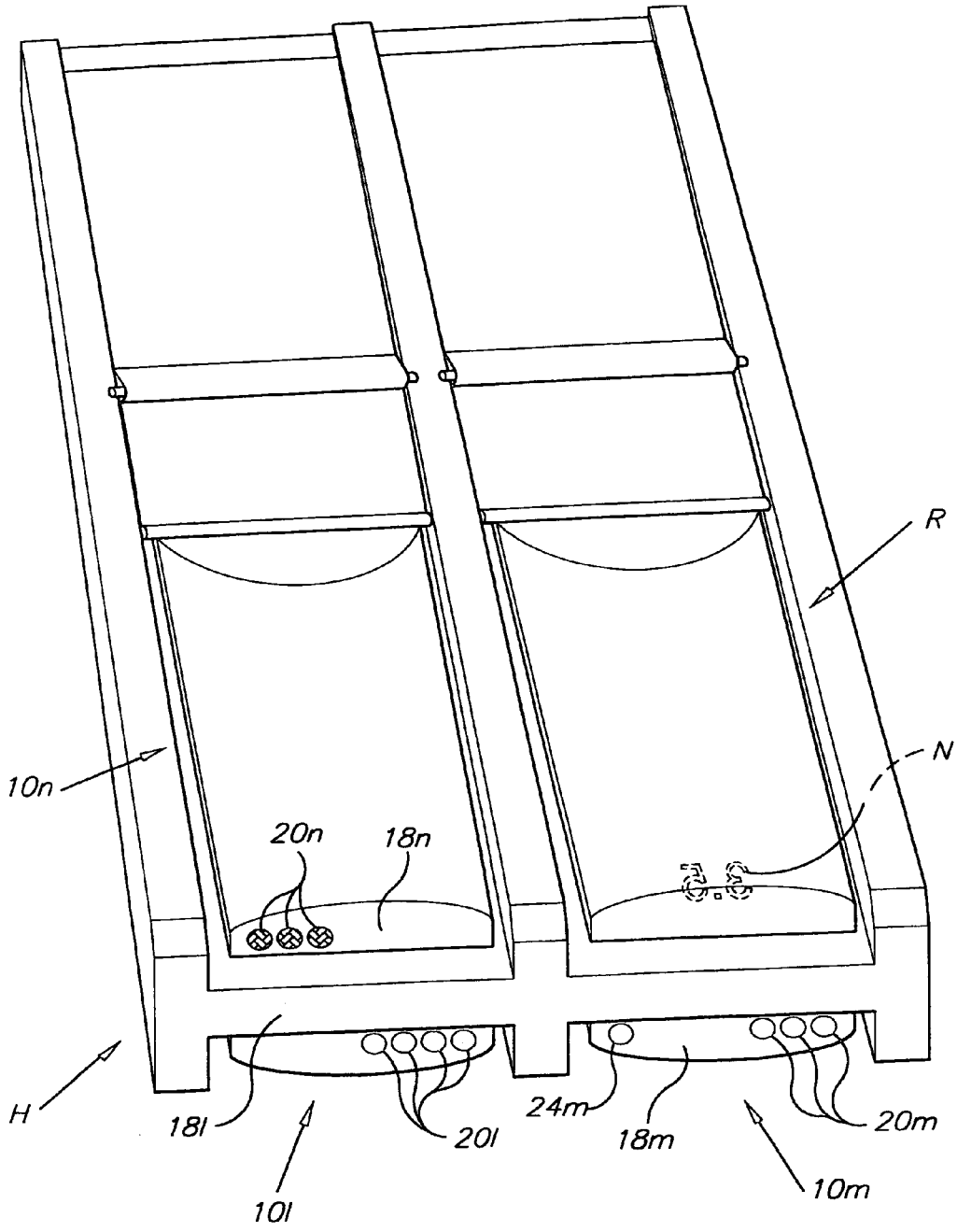
FIG. 8 is a perspective view of a series of reeds marked according to the present invention and stored in a reed holder, with the markings of the present invention being clearly visible.

FIG. 8 provides an illustration of a conventional multiple reed holder H, in which a series of four reeds are removably secured. Such reed holders conventionally secure reeds therein with their flat surfaces held against a flat reed holder surface, in order to prevent the reeds from warping as they dry. The lower portion of the reed holder H contains a no. 4 reed 10*l* secured within the lower left portion of the reed holder H, with the grade of the reed 10*l* being clearly visible due to the four dots or marks 20*l* disposed upon the exposed blunt end 18*l* of the reed. The adjacent lower right compartment or portion of the reed holder H contains a no. 3½ reed 10*m*, as indicated by the three integer marks 20*m* and single fractional mark 24*m* disposed upon the blunt end 18*m* of the reed.

Another reed 10*n* is stored in the upper left compartment or portion of the reed holder H. This is a no. 3 reed, as indicated by the three integer marks 20*n* disposed upon the blunt end 18*n* of the reed. The integer marks 20*n* are colored, e.g., orange (any other color may be used, as desired) in order to distinguish the reed type from other reeds having very similar appearance, as is the case between e.g., clarinet and soprano saxophone reeds. Other means may be used to differentiate such different reeds for different musical instruments, e.g., differently shaped or configured marks, etc., as desired.

The upper right portion or compartment of the reed holder H contains a conventionally numbered reed R. As the reed gradient number is placed upon the flat surface of the reed R, and that flat surface is face down against the floor of the reed holder H, the number cannot be seen when the conventional reed R is secured in the reed holder H. (The number N, i.e. 3.5, is shown in broken lines on the concealed flat surface of the reed R in FIG. 8, to indicate its concealed condition.) Without the present marking system, there is no way to determine the gradient of the reed R without removing it from the reed holder H. However, the present marking system may be applied to conventionally numbered reeds so the reeds contain both the conventional gradient number and the present marking system as well, if so desired.

Figure 9:
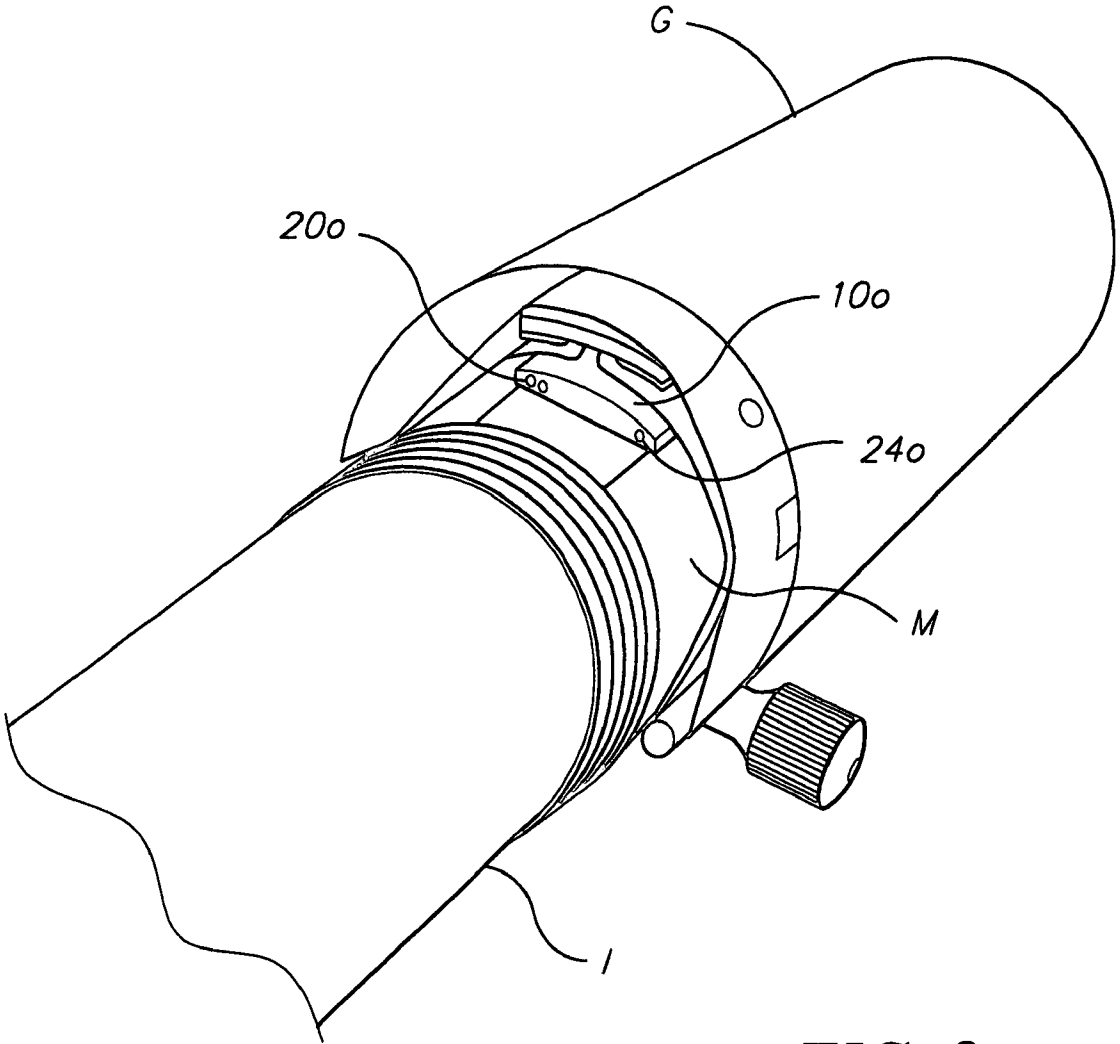
FIG. 9 is a detailed perspective view of the capped mouthpiece of a clarinet, showing the forward end of a no. 2.5 reed according to the present invention with its markings clearly visible.

FIG. 9 provides an environmental perspective view of a reed 10*o* using the present marking system, installed within the mouthpiece M of a musical instrument 1. The mouthpiece M is mostly concealed by a protective guard G, conventionally installed over such mouthpieces M to protect the thin end of the reed during brief periods between playing the instrument. It will be appreciated that the gradient number of a conventional reed would not be visible when the reed is installed within the mouthpiece of the instrument, for the reasons noted further above. However, the integer marks 20*o* and half or fractional mark 24*o* of a no. 2½ reed 10*o* using the present marking system is readily visible when the reed 10*o* is installed in the instrument mouthpiece M, even with the guard G installed over the end of the mouthpiece M.

Figure 10:
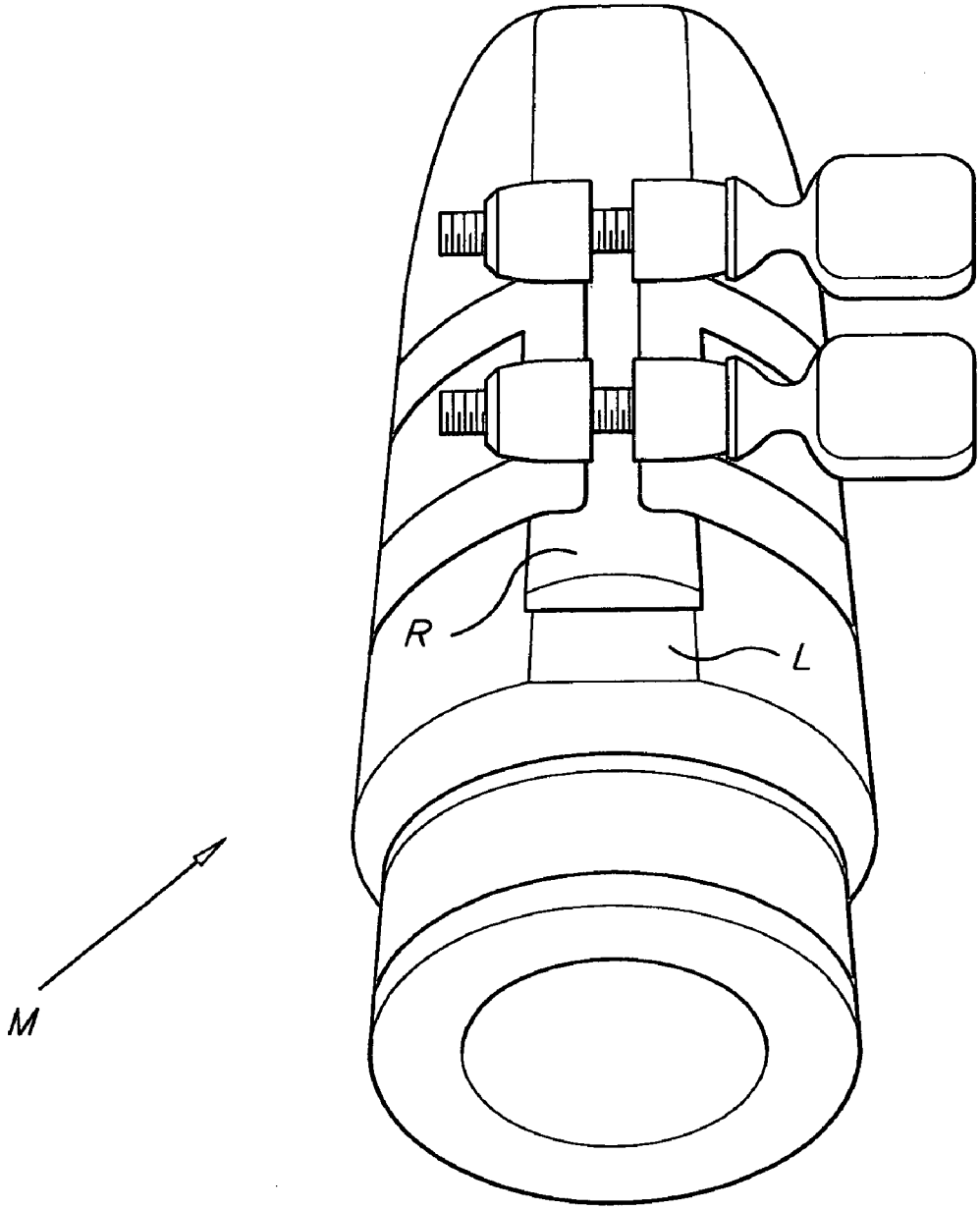
FIG. 10 PRIOR ART
FIG. 10 is a perspective view of a clarinet mouthpiece having a prior art reed installed therein, with the reed markings being concealed in such an installation.

Finally, FIG. 10 illustrates a musical instrument mouthpiece M as removed from a musical instrument, but having a conventional reed R installed therein. It will be noted that even with the musical instrument and mouthpiece guard being removed, it is still impossible to view the conventional grading number of the reed R due to its location on the flat surface of the reed immediately adjacent the lay L of the mouthpiece M. The reed R would have to be removed from the mouthpiece M in order for the musician to see the reed number, to determine the gradient of the reed R.

The present marking system, with its series of integer marks and (as required) fractional marks disposed upon the blunt end of the reed, overcomes this problem and allows the musician to see exactly what the gradient of the installed reed is at all times. The present marking system may incorporate any type of markings as desired, so long as they are located on the blunt end of the reed which is exposed to view when the reed is installed in the instrument and when the reed is stored in many conventional reed holders as well. Raised or recessed markings, and/or markings having high visibility in low light conditions, may also be used in order to enable musicians to quickly determine what the value of a given reed is under virtually any circumstances. Accordingly, the present reed marking system will prove to be most valuable to reed manufacturers and musicians everywhere who play such reed instruments.

An additional aspect of the invention includes using similar markings as described above on reed boxes and reel holders to assist visually impaired users or users in low lighting environments. Protruding markings may be located on reed boxes and reed holders corresponding to identical reed markings so that users may identify the reed boxes and reed holders by identifying the raised markings by touch.

It is to be understood that the present invention is not limited to the embodiments described above, but encompasses any and all embodiments within the scope of the following claims.

I claim:

1. A method for marking a grade of a musical instrument reed, the reed having at least a blunt end opposite a thin, tapered vibratory end, the method comprising the step of:

applying at least one mark corresponding to an integer indicating the reed grade upon a first side of the blunt end of the musical instrument reed and a single mark upon an opposite second side of the blunt end when the reed grade includes a half integer value;

whereby said at least one mark is visible when the musical instrument reed is installed within the mouthpiece of a musical instrument or stored within a multiple reed holder, thereby permitting determination of the grade of the reed without removal of the reed from the instrument mouthpiece or from the reed holder.

2. The method for marking a grade of a musical instrument reed according to claim 1, wherein said applying step comprises applying a plurality of marks upon the first side of the blunt end of the reed.

3. The method for marking a grade of a musical instrument reed according to claim 2, further comprising the steps of:

placing said plurality of marks in a linear array, the plurality of marks corresponding to an Arabic integer number greater than one; and placing said single second mark in linear alignment with said plurality of marks of said first side.

4. The method for marking a grade of a musical instrument reed according to claim 1, wherein said at least one mark is selected from the group consisting of regular and irregular geometric and non-geometric shapes, pattern, and symbols.

5. The method for marking a grade of a musical instrument reed according to claim 1, wherein said at least one mark is fluorescent.

6. The method for marking a grade of a musical instrument reed according to claim 1, wherein said at least one mark is phosphorescent.

7. The method for marking a grade of a musical instrument reed according to claim 1, wherein said at least one mark is raised.

8. The method for marking a grade of a musical instrument reed according to claim 1, wherein said at least one mark is depressed.

9. The method for marking a grade of a musical instrument reed according to claim 1, wherein said at least one mark is colored.

10. A musical instrument reed, comprising:

a single, broad musical instrument reed having a blunt end opposite a thin, tapered vibratory end, the blunt end having a first side and a second side opposite the first side; and at least one mark corresponding to an integer indicating a reed grade disposed upon the first side of the blunt end of said musical instrument reed and a single mark upon the second side of the blunt end when the reed grade includes a half integer value;

whereby said at least one mark is visible when said musical instrument reed is installed within the mouthpiece of a musical instrument or stored within a conventional multiple reed holder, thereby permitting determination of the grade of said musical instrument reed without removal of said musical instrument reed from the instrument mouthpiece or from the reed holder.

11. The musical instrument reed according to claim 10, wherein:

said at least one mark comprises a plurality of marks placed upon the first side of the blunt end of the musical instrument reed in a linear array, corresponding to an integer greater than one; and single second mark is selectively placed upon a second side of the blunt end of the musical instrument reed in linear alignment with said plurality of marks.

12. The musical instrument reed according to claim 10, wherein said at least one mark is selected from the group consisting of regular and irregular geometric and non-geometric shapes, patterns, and symbols.

13. The musical instrument reed according to claim 10, wherein said at least one mark is fluorescent.

14. The musical instrument reed according to claim 10, wherein said at least one mark is phosphorescent.

15. The musical instrument reed according to claim 10, wherein said at least one mark is raised.

16. The musical instrument reed according to claim 10, wherein said at least one mark is depressed.

17. The musical instrument reed according to claim 10, wherein said at least one mark is colored.

* * * * *